US005533716A

United States Patent [19]

Deplano et al.

[11] Patent Number: 5,533,716

[45] Date of Patent: Jul. 9, 1996

[54] METHOD AND DEVICE FOR QUENCHING, PARTICULARLY FOR STEEL TUBES OR SIMILAR

[75] Inventors: Stefano Deplano; Eugenio Melis; Roberto Millone, all of Genoa, Italy

[73] Assignee: Iritecna Societa per l'Impiantistica Industriale e l'Assetto del Territorio p.A., Genoa, Italy

[21] Appl. No.: 367,817

[22] Filed: Jan. 3, 1995

[30] Foreign Application Priority Data

Jan. 5, 1994 [IT] Italy ..... GE94A0001

[51] Int. Cl.[6] ..... C21D 1/62

[52] U.S. Cl. ..... 266/114; 148/579

[58] Field of Search ..... 266/103, 114; 148/579

[56] References Cited

U.S. PATENT DOCUMENTS

| | | | |
|---|---|---|---|
| 2,307,694 | 1/1943 | Malke | 266/114 |
| 3,915,763 | 10/1975 | Jennings et al. | 266/114 |
| 3,937,448 | 2/1976 | Fujii et al. | 266/114 |
| 4,490,187 | 12/1984 | Kruppert | 266/114 |
| 4,504,042 | 3/1985 | Kruppert | 266/114 |
| 4,575,054 | 3/1986 | Kruppert | 266/114 |

FOREIGN PATENT DOCUMENTS

| | | |
|---|---|---|
| 0089019 | 9/1983 | European Pat. Off. . |
| 1082362 | 12/1954 | France . |
| 2661689 | 11/1991 | France . |
| 1216906 | 5/1966 | Germany . |

*Primary Examiner*—Scott Kastler
*Attorney, Agent, or Firm*—Larson and Taylor

[57] ABSTRACT

In a method for quenching, particularly for steel tubes or similar, the tube (T) is quenched by a vortical flow of cooling liquid at least along the outer shell surface, with at least a circulatory motion inside the tube. The vortical flow of cooling liquid has a component of circulatory motion in the circumferential direction around the outer shell surface of the tube and a component of motion in the axial direction with respect to the tube. A device for the application of the method has a container (1) for the tube (T), with at least one source (18, 217) of supply of an external cooling liquid flow, and with an outlet (101) for the discharge of the flow from the container (1). The source (18, 217) of supply of the external cooling liquid flow is such that it generates the flow in a circumferential direction with respect to the tube (T). The discharge aperture (101) is provided at one end of the container (1) and its dimensions are such that they produce a component of the flow in the axial direction with respect to the tube (T) in the external cooling liquid flow.

12 Claims, 4 Drawing Sheets

25
5'
20
13
14
12
16
15
4
104
205
6
5
1
101
103
3

METHOD AND DEVICE FOR QUENCHING, PARTICULARLY FOR STEEL TUBES OR SIMILAR

FIELD OF THE INVENTION

The invention relates to a method and a device for quenching, particularly for steel tubes or similar.

In the method according to the invention, a steel tube, for example, is quenched by means of a vortical flow of cooling liquid which extends at least along the outer shell surface of the said tube, circulating around it.

BACKGROUND OF THE INVENTION

There is a known method of this type in which the cooling liquid flow is made to circulate only in the circumferential direction around the whole tube, without having any component of motion in the axial direction with respect to the tube.

This circulation has the purpose of limiting the formation of water vapour bubbles, thus ensuring a constant contact between the cooling liquid and the outer surface of the tube, to promote the cooling action.

SUMMARY OF THE INVENTION

The object of the invention is to provide a method of quenching, particularly for steel tubes, with which it is possible to augment the cooling action of the cooling liquid on the part to be quenched, thus obtaining an improvement of the quenching process.

The invention achieves the said object with a method of quenching, particularly for steel tubes, or similar, of the type described initially, in which the tube is quenched by means of at least one vortical flow of cooling liquid with a component of circulatory motion in the circumferential direction around the outer shell surface of the tube and with a component of motion in the axial direction with respect to the tube.

The external cooling liquid flow extends over the whole length of the tube (T) to be quenched.

According to an improvement, a plurality of flows of liquid to cool the outer shell surface of the tube is provided. The flows are simultaneous and adjustable independently of each other with respect to the flow rate, and being distributed, with respect to where they are emitted, axially along the tube. Each flow is associated with one of a number of successive predetermined axial portions of the tube.

Advantageously, a further flow of cooling liquid for the inner shell surface of the tube may be provided. Such further flow may be simultaneous with the flow or flows of external cooling liquid and has a component of circumferential circulation and a component of axial motion.

The internal cooling liquid flow may be mixed with a flow of gas, for example a flow of air.

A further object of the invention is a device for the application of the said method. This device comprises a container for the tube or part to be quenched associated with at least one source of supply of an external cooling liquid flow, around the outer shell face of the tube, or at least around a partial axial portion of the tube shell. An outlet for the discharge of the said cooling liquid flow from the container is also provided together with means of introducing and means of removing the said tube or part to be quenched into and from the container.

The source or sources of supply of the cooling flow external to the tube are disposed so that they generate a cooling liquid flow in a circumferential direction, circulating around the whole outer shell surface of the tube. At one axial end of the container there is provided a discharge aperture made so that, for any specified tube diameter, the cooling liquid flowing around the outside of the tube is discharged through it. This discharge generates a flow component in the axial direction with respect to the tube, in the direction of the said discharge aperture, for each circumferential flow of cooling liquid.

The invention also relates to other characteristics which further improve the method and the device described above, and which as described hereafter.

BRIEF DESCRIPTION OF THE DRAWINGS

The particular characteristics of the invention and the advantages derived therefrom will be more clearly understood from the following description of a preferred embodiment, illustrated by way of example and without restriction in the attached drawings, in which.

DESCRIPTION OF THE PREFERRED EMBODIMENT

Figure 1:
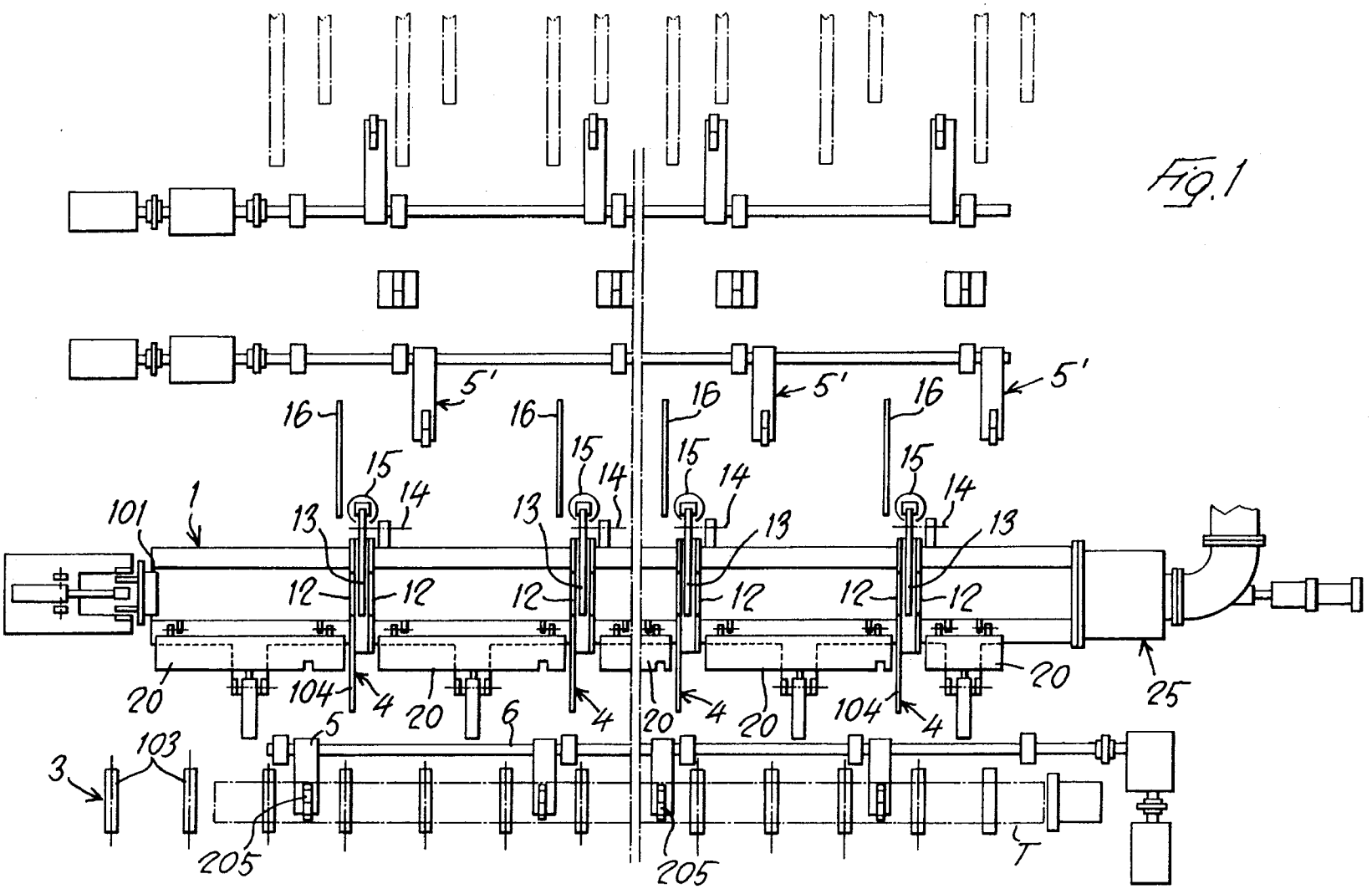
FIG. 1 is a plan view of a device for quenching steel tubes according to the invention.

A quenching device, particularly for steel tubes T, comprises a container 1 in which the tubes to be quenched are placed one at a time. The container 1, which is open at the top, has an open circular section, with an angle size greater than 180° and inside it there is disposed a plurality of transverse tube support ribs 2 which have a U-shaped profile on the inner side. On one side of the container 1 there are provided means of transferring the tube T which collect the tube from a conveyor line 3, for example a roller line, and transfer it to a feed chute 4. The tube T is brought into the collection position, laterally adjacent and parallel to the container 1. The transfer means collect the tube and align it so that it is exactly parallel to the longitudinal axis of the container at the moment of deposition on the feed chute 4, by means of aligning members 105. The chute 4 has a rolling surface 104 which is inclined towards the container 1 and which terminates with the said side facing the container 1 vertically aligned with the lateral branches of the tube support ribs 2, at a certain height above the container 1. According to the embodiment illustrated, the transfer means consist of a plurality of arms 5 which are mounted so that they pivot about a common axis parallel to the longitudinal axis of the container 1. The pivot axis is in an intermediate position between the roller line 3 and the entry end of the inclined rolling plane 4. In particular, the arms 5 are mounted so that they are distributed over the length of a common driving shaft 6 in positions alternating with the rollers 103 of the roller line 3 and with transverse ribs 204 whose edges form the inclined rolling plane 104 and which are joined in one piece with the tube support ribs 2 in the container 1.

Figure 5:
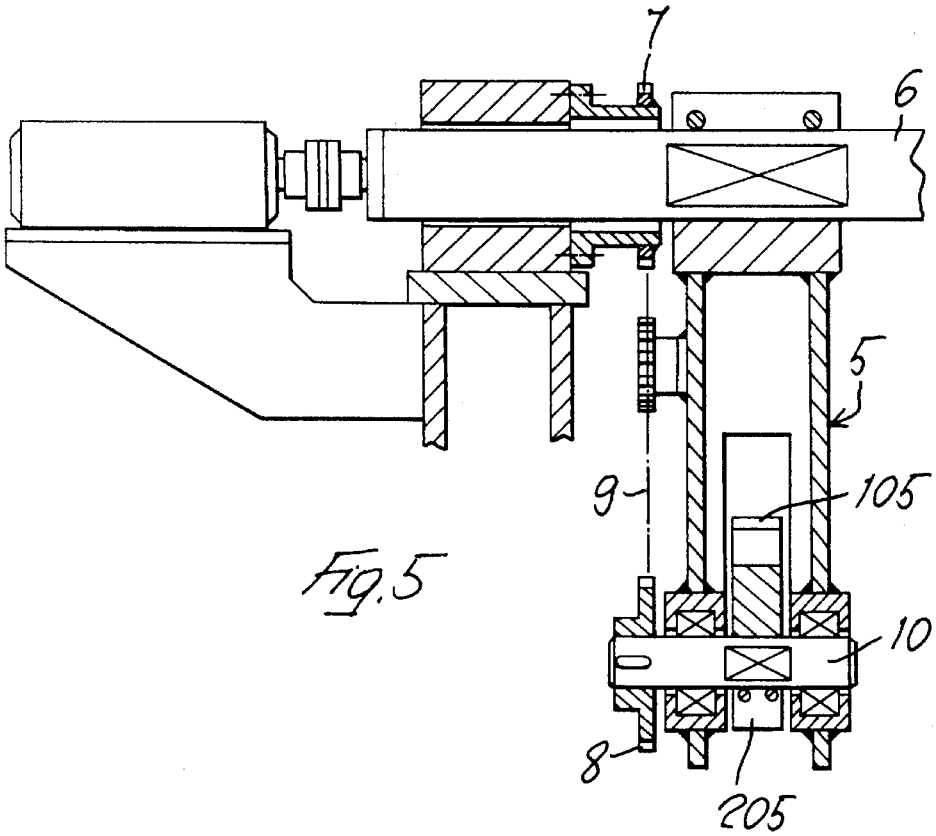
FIG. 5 shows a detail relative to a conveyor arm of the feeder that passes the tubes to be quenched to the quenching container.

At the free ends of the arms 5 there are hinged in a pivoting way tube support cradles 205 which are concave, and in particular have a V-shaped upper profile. The tube support cradles 205 pivot about an axis parallel to the longitudinal axis of the container 1. Each tube support cradle 205 is associated with means which keep it constantly facing upwards in the horizontal position during the pivoting of the corresponding arm 5. These means may consist of a pair of pulleys or gear wheels 7 and 8, which are interconnected by belts or chains 9, as shown in FIG. 5. One of the said gear wheels 7 is static and rotatable with respect to the shaft 6, while the other is fixed on and rotatable with a supporting shaft 10 which is mounted freely rotatably at the free end of the arm 5 and to which the tube support cradle 205 is fixed. At the front end, and also at the rear end if necessary, with respect to the transfer movement, the tube support cradles 205 have projecting stops which form the aligning members 105.

Consequently, at the time of transfer, particularly of a tube of small diameter with respect to the dimensions of the concave housing of the cradles 205, the said tube is supported in a position exactly parallel to the container 1. This ensures that the tube drops in an inclined position into the container 1 after the rolling portion 104. In this way, the tube T is in contact substantially simultaneously with all the tube support ribs 2, avoiding the risk of deformation which otherwise be present.

The slight inclination of the rolling plane 104 is adjusted to keep to a minimum the horizontal component of motion during the free drop of the tube T into the container. This enables a substantially vertical drop of the tube T to be obtained, within the limits of tolerance of the U-shaped concavity of the tube support ribs 2, preventing the tube from striking the opposite vertical branches of the said tube support ribs 2 with a consequent risk of deformation.

Figure 2:
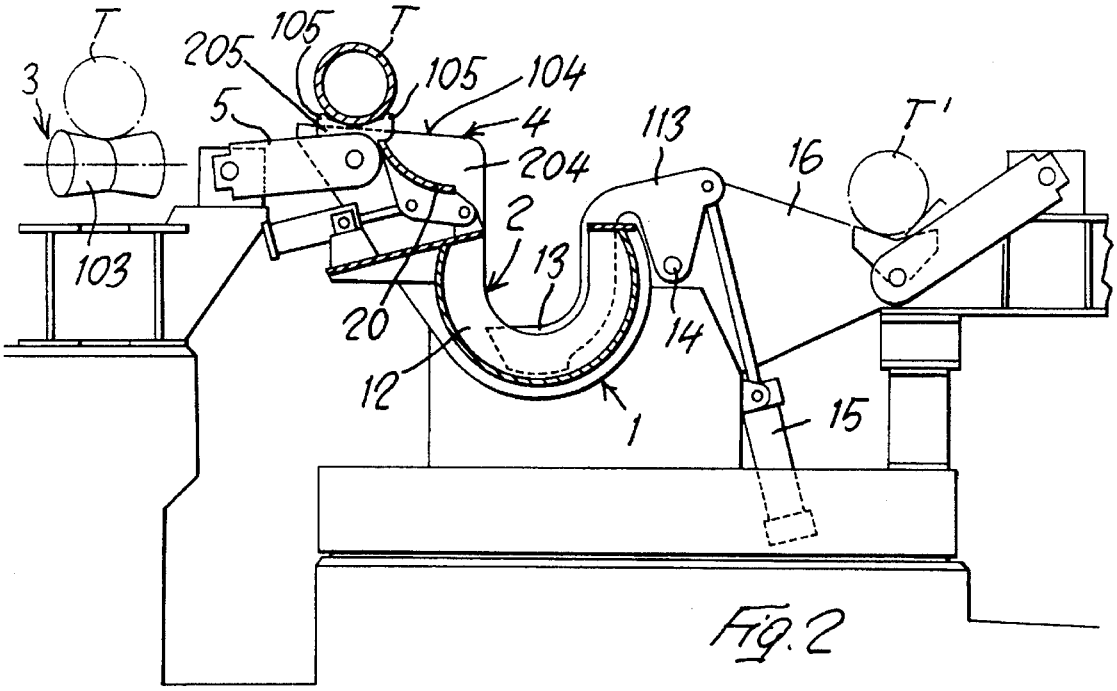
FIG. 2 is a transverse section through the quenching container shown in FIG. 1.
Figure 3:
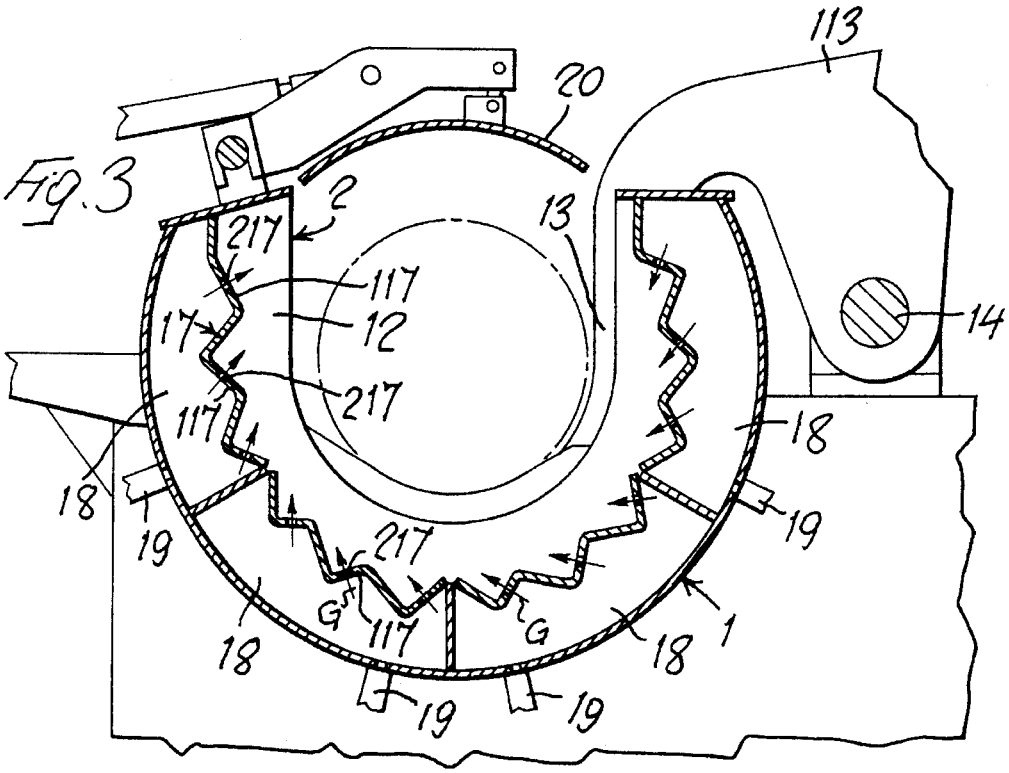
FIG. 3 shows an enlarged transverse section through the quenching container shown in FIGS. 1 and 2, and the means of generating a circumferential external flow of cooling liquid.

As shown in FIGS. 2 and 3, the tube support ribs 2 consist of static transverse ribs 12 with a U-shaped concavity open upwardly, between which there are interposed pivoting ribs 13 which form the discharge cradles and which have a profile in the form of a hook or a partial U-shape, without the vertical branch of the U on the tube feed side. The pivoting ribs 13 form the actual lower support of the tube T in the container 1. They have extensions 113 outside the container 1 on its discharge side for the quenched tube. The said pivoting ribs 13 are mounted on parallel and coaxial axes 14 which are parallel to the container 1 and are made to rotate about it by means of one or more hydraulic cylinders 15. Their profile is such that, in their raised position, the quenched tube T' is transferred by rolling by gravity on an inclined discharge plane consisting of a plurality of ribs 16 similar to the chute 4 and from which it is collected by transfer means 5' substantially similar to those on the tube feed side of the container 1.

Figure 6:
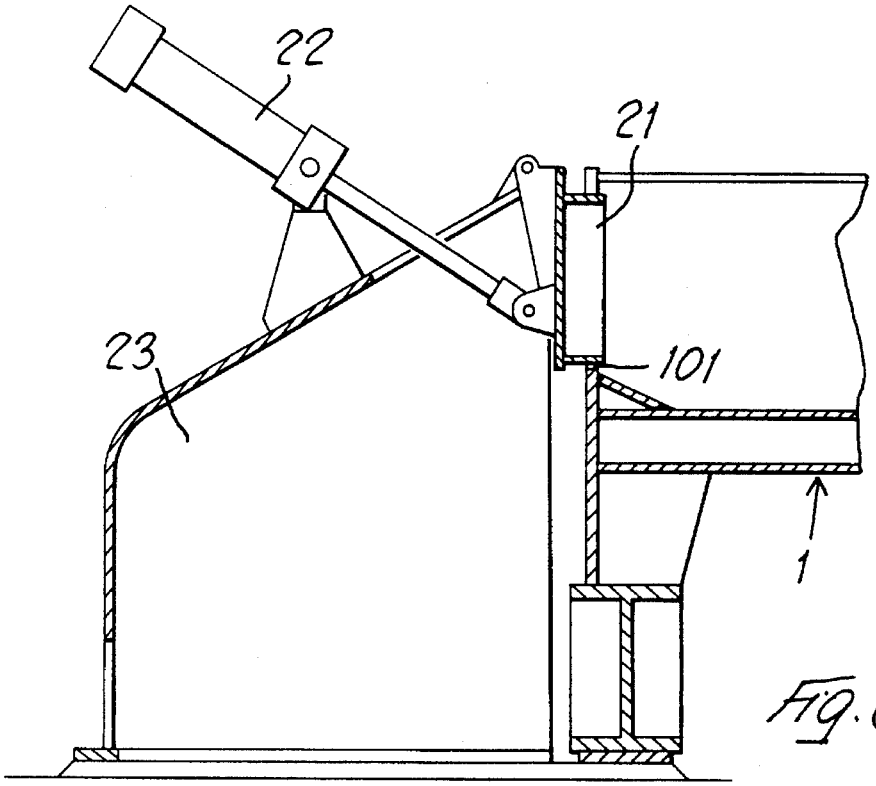
FIG. 6 shows an axial section of the end part provided with the aperture for the discharge of the cooling liquid from the quenching container.

The static ribs 12 in the container 1 combine to divide into a plurality of axial segments a feed cavity for the cooling water flow which extends over the whole angular extension of the circular wall of the container 1 and over its whole axial length. This feed cavity is delimited towards the interior of the container 1 by a wall 17 shaped so that it has a plurality of segments 117 perpendicular to the corresponding directions tangential to the tube T. The said segments 117 of wall 17 extend substantially over the whole axial length of the container 1 and each has an axial row of holes 217 or nozzles supplying jets of cooling liquid, which are thus orientated substantially tangentially to the outer shell surface of the tube T. The combination of the tangential jets G creates a circumferential cooling flow around the tube T which is independent for each axial sector between two static transverse ribs 12. The cavity may advantageously be further divided in the circumferential direction of the container 1 into a plurality of chambers 18, each of which is supplied separately through an inlet 19 with the cooling liquid. The open upper side of the container 1 may be closed from the outside by a cover 20 or by a plurality of successive covers distributed in a row along the container 1, with a transverse section in the form of a circular sector substantially complementary to the circumferential flow. In addition to acting as splash-guards, the covers 20 form a deflecting surface for the circumferential flow of the cooling liquid. On one end of the container 1 there is provided, in a position substantially coinciding with the tube T, an aperture 101 for the discharge of the cooling liquid which has a section greater or slightly greater than the tube of greatest diameter which can be housed in the container 1. The discharge aperture 101 (FIG. 6) may be opened and closed by means of a hatch 21 which is mounted so that it can pivot and is operated by a cylinder 22. The said discharge aperture 101 communicates with a discharge duct 23. The circumferential flows of cooling liquid located in the various axial sectors of the container 1 and delimited by the static ribs 12 therefore acquire a further component in the axial direction with respect to the tube T and container 1. This enables the cooling to be carried out in conditions of dynamic flow of the cooling liquid with a continuous exchange of the cooling liquid and a greater contact of the liquid with the surface of the tube, contributing to an improvement in the quenching action.

The hatch 21 makes it possible to close the discharge aperture and therefore to maintain a certain level of cooling liquid in the container 1 at the time of introduction of a tube T. This is advantageous for mitigating the impact of the tube T at the time of its vertical drop into the container 1.

Figure 4:
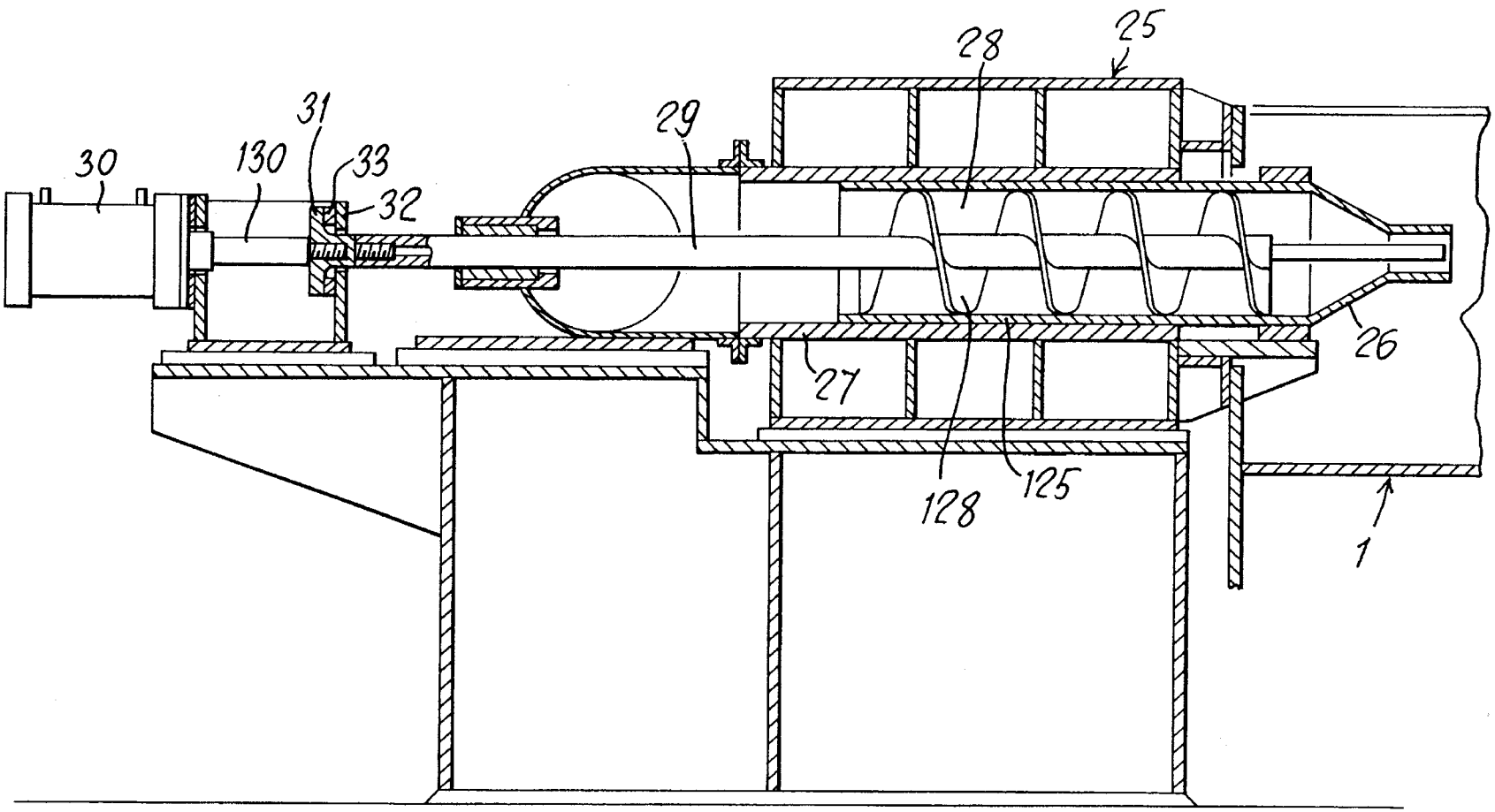
FIG. 4 shows the means for supplying a flow of cooling liquid to the interior of the tube.

The tube T may also be subjected to an internal cooling flow simultaneous with an external cooling flow. For this purpose, injection means (FIG. 4) are provided on the end of the container 1 opposite the discharge aperture 101.

The injection means 25 are made so that they can be connected to and removed from the corresponding end of the tube T by means of an axial sliding movement. They have an injection end 26 made in the shape of a funnel corresponding to the minimum and maximum diameters of tubes which can be treated with the said equipment, and which is inserted in the corresponding end of the tube T.

The injection means 25 have a cylindrical tubular body 125 which is disposed with its axis aligned with the axis of the container 1 and which is supported axially slidably and with a seal in a guide 27 at the corresponding end of the container 1. A coaxial helical duct 28 for the cooling liquid is formed in the cylindrical chamber, by a helical wall 128 which is supported by a concentric tubular bar 29. The concentric tubular bar 29 is fixed to the tubular body 125 by means of the helical wall 128 and its rear end outside the tubular body 125 is connected to a double-acting hydraulic cylinder 30 for the axial movement of the injector 25. The rod 130 of the actuator cylinder 30 is connected to the tubular bar 29 by means of a stop disc 31 which interacts with a transverse stop wall 32 by means of an annular elastic shock-absorber 33, so that the impact is absorbed and distributed uniformly over the whole of the disc 31.

The internal duct of the tubular bar 29 communicates with a source of a gas, for example air, while its end facing the container 1 terminates concentrically inside the funnel-shaped injection end 26, slightly before the end of the injection end.

To cool the inner surface of the tube, the injector 25 is moved axially against the tube, by inserting the injection end 26 into the associated terminal portion of the said tube. A flow of cooling liquid which may be, and preferably is, mixed with a flow of gas, is supplied to the interior of the tube through the tubular bar 29, the cooling flow having a helical form, in other words with a circumferential component and an axial component of motion. The said flow is also discharged from the container 1 through the aperture 101 at the end opposite the injector.

As will be understood from the description above, the tube may be quenched with an internal cooling liquid flow and an external cooling liquid flow, each of these flows having a circumferential component along the corresponding side of the tube shell wall and an axial component. Additionally, both the said flows consist not of simple flows of recirculation of the same body of cooling liquid present in the container, but of a flow in equilibrium conditions of new cooling liquid, possibly in a closed circuit for the liquid in which a heat exchanger is provided to cool the liquid discharged from the container 1, the surface of the treated tube being constantly in dynamic conditions with new cooling liquid.

While the internal flow permits only one adjustment of its flow rate and of the parameters of mixing with the gas which may be supplied simultaneously, the external flow may be adjusted in respect of its local flow rate separately for each axial sector of the tube delimited by the static transverse ribs 12. This enables the quenching action to be adjusted in relation to any variations of thickness in the axial direction of the tube wall, ensuring optimal quenching of the tube.

We claim:

1. A device for quenching at least a tube part of a tube with a flow of a cooling liquid comprising:

an elongate container in which the tube part to be quenched is located, said container being horizontally disposed and including a longitudinal axis which is horizontal, a flow means for generating a flow of the cooling liquid circumferentially and completely about an outer surface of the tube part in said container, a discharge outlet at an axial end of said container through which the cooling liquid introduced into said container by said flow means is discharged from said container, said discharge outlet generating a flow component in an axial direction for the flow generated by said flow means circumferentially about the outer surface of the tube part, a hatch which closes said discharge aperture, and a hatch moving means for moving said hatch between a closed position where said discharge outlet is closed and an opened position where flow through said discharge outlet is permitted;

an introducing means for introducing the tube part to be quenched into said container, said introducing means including a feed chute slightly inclined from horizontal on which the tube part rolls by gravity into said container, said feed chute having an entry end, members adjacent the entry end of said feed chute on which said tube part rests, said members being positioned to align a longitudinal tube axis of the tube part exactly parallel with the longitudinal axis of said container, and a lowering means to lower said members simultaneously whereby said tube part is vertically lowered onto said feed chute with the longitudinal tube axis thereof exactly parallel to the longitudinal axis of said container; and a removing means for removing the tube part from said container after quenching.

2. A device for quenching a tube part as claimed in claim 1, wherein said container includes a peripheral wall along the length thereof and a delimiting wall along the length of the peripheral wall forming a cavity therebetween into which cooling liquid is introduced; and wherein said flow means are a plurality of circumferential rows of emission holes in said delimiting wall, each of said holes of a said row being equally spaced from one another and having an emission axis for the cooling liquid oriented in a direction substantially tangential to the outer surface of the tube part in said container.

3. A device for quenching a tube part as claimed in claim 2 wherein said delimiting wall of said container has a zig-zag transverse section formed of first and second flat segments, each said first flat segment being oriented perpendicular to a corresponding tangential of the outer surface of the tube part in said container, and said emission holes being provided in said first segments.

4. A device for quenching a tube part as claimed in claim 3 wherein said cavity of said container is divided into separate axial cavity portions each of which said axial cavity portions is separately provided with cooling liquid.

5. A device for quenching a tube part as claimed in claim 4 wherein said container includes static transverse ribs which extend from said peripheral wall through said cavity to divide said cavity into said axial cavity portions and which said transverse ribs further extend beyond said delimiting wall into engagement with the tube part in said container.

6. A device for quenching a tube part as claimed in claim 5 wherein each said axial cavity portion includes a divider which divides each said axial cavity portion into a plurality of circumferential chambers each of which is separately provided with cooling liquid.

7. A device for quenching a tube part as claimed in claim 5 wherein said transverse ribs form a U-shaped housing for the tube part in said container.

8. A device for quenching a tube part as claimed in claim 1 wherein said feed chute includes a rolling surface inclined towards said container on which the tube part is deposited by said lowering means from said members, said rolling surface being so inclined as to reduce a horizontal motion component of the tube part rolling thereon to an exit side of said feed chute to a minimum, and a vertical edge at the exit end of said rolling surface, said vertical edge being disposed substantially vertically and aligning at a lower portion thereof laterally with a lateral edge of the U-shaped housing formed by said transverse ribs.

9. A device for quenching a tube part as claimed in claim 1:

further including a feed line which delivers the tube to a position adjacent said container; and wherein said lowering means of said introducing means includes a plurality of transfer arms, each said transfer arm having an upper support cradle on which a respective said member is provided, so that said lowering means moves said arms simultaneously and in synchronization about a common pivot axis parallel to the longitudinal axis of said container from a collection position where the tube is collected from said feed line to a discharge position where the tube part is positioned in said members and then lowered onto said feed chute.

10. A device for quenching a tube part as claimed in claim 9 wherein each respective said support cradle is pivotally mounted to a respective transfer arm, and wherein said introducing means further includes a keeping means for keeping each said support cradle positioned with an associated said member facing upwards whereby the tube part is engaged at the collection position with said members and moved from the collection position to the discharge position while engaged with said members.

11. A device for quenching a tube part as claimed in claim 10 wherein each said member is a support surface of a respective said support cradle which is V-shaped in transverse cross section so that the tube part is precisely aligned centrally in the V-shaped support surface as the tube part is moved from the collection position to the discharge position.

12. A device for quenching a tube part as claimed in claim 1 wherein said container includes an injection means at an axial end of said container opposite to the axial end where said discharge outlet is located for injecting a flow of cooling liquid onto an inner surface of the tube part, said injection means including a seal with which said injection means removably engages an end of the tube part in said container.

* * * * *